US008139717B2

(12) United States Patent
Harding et al.

(10) Patent No.: US 8,139,717 B2
(45) Date of Patent: Mar. 20, 2012

(54) SECONDARY COLLIMATOR AND METHOD OF MAKING THE SAME

(75) Inventors: Geoffrey Harding, Hamburg (DE); Helmut Rudolf Otto Strecker, Hamburg (DE); Peter Michael Edic, Albany, NY (US)

(73) Assignee: Morpho Detection, Inc., Newark, CA (US)

( * ) Notice: Subject to any disclaimer, the term of this patent is extended or adjusted under 35 U.S.C. 154(b) by 97 days.

(21) Appl. No.: 12/572,938

(22) Filed: Oct. 2, 2009

(65) Prior Publication Data

US 2011/0081004 A1 Apr. 7, 2011

(51) Int. Cl.
*G21K 1/02* (2006.01)

(52) U.S. Cl. ..... 378/147; 378/84

(58) Field of Classification Search ..... 378/70–90, 378/147, 149, 145

See application file for complete search history.

(56) References Cited

U.S. PATENT DOCUMENTS

| | | | | |
|---|---|---|---|---|
| 3,058,503 | A * | 10/1962 | Perakis | 83/764 |
| 3,869,615 | A * | 3/1975 | Hoover et al. | 378/146 |
| 4,493,098 | A * | 1/1985 | Riihimaki et al. | 378/146 |
| 4,856,043 | A | 8/1989 | Zola | |
| 6,266,392 | B1 | 7/2001 | Fujinawa et al. | |
| 6,307,917 | B1 | 10/2001 | Shimizu et al. | |
| 6,587,538 | B2 * | 7/2003 | Igarashi et al. | 378/19 |
| 7,127,037 | B2 | 10/2006 | Bowen et al. | |

* cited by examiner

*Primary Examiner* — Hoon Song
(74) *Attorney, Agent, or Firm* — Armstrong Teasdale LLP

(57) ABSTRACT

A method for making a secondary collimator that includes at least one plate having a plurality of slits defined therein includes determining a gap thickness between plate positions of the secondary collimator based on at least one dimension of the at least one plate and fabricating a base plate from a base plate blank. The base plate includes at least two slots being spaced apart by the gap thickness. The at least one plate is inserted into a first slot of the at least two slots to form the secondary collimator.

11 Claims, 6 Drawing Sheets

SECONDARY COLLIMATOR AND METHOD OF MAKING THE SAME

BACKGROUND OF THE INVENTION

1. Field of the Invention

The embodiments described herein relate generally to a collimator for use in X-ray imaging systems and, more particularly, to a secondary collimator for use with an X-ray diffraction imaging (XDI) system.

2. Description of Related Art

At least some known security detection devices utilize X-ray imaging for screening luggage. For example, XDI systems provide an improved discrimination of materials, as compared to that provided by more conventional X-ray baggage scanners, by measuring d-spacings between lattice planes of micro-crystals in materials. A "d-spacing" is a spacing between adjacent layer planes in a crystal.

At least one such XDI system that uses an inverse fan-beam geometry (a large source and a small detector), such as a multiple inverse fan beam (MIFB) topology, and a multi-focus X-ray source (MFXS) has been proposed. To allow examination of objects having a width of up to about 1 meter (m), a relatively large number of detector elements are required. At least one known XDI system includes a secondary collimator defined by an array of slits in a series of high Z (tungsten alloy) baffles. A "high Z" material is a material having a high atomic number, such as, for example, tungsten (Z=74), platinum (Z=78), gold (Z=79), lead (Z=82), and/or uranium (Z=92). However, such a secondary collimator does not permit the number of detector elements to be increased because the baffles cannot be fabricated to include a high number of slits without adversely affecting the operability of the secondary collimator. Moreover, such known secondary collimators are difficult and expensive to manufacture because the collimators are fabricated from tungsten alloy.

Another known collimator for use with X-ray investigation systems is a Soller slit collimator. At least some known Soller slit collimators commonly include a stack of continuous plates that are regularly spaced with respect to each other. If a plate separation is P and a length of the Soller slit collimator in a propagation direction is L, a maximum angular divergence, $\Delta\theta$of a beam emerging from the Soller slit collimator is equal to about P/L, a parameter that is also known as the aspect ratio.

The MIFB topology of an XDI system requires a fixed angle secondary collimator (FASC) that is, in principle, a stack of Soller slit collimators having a relatively high aspect ratio. An MIFB FASC can include up to 25 plates stacked parallel to each other with a pitch of about 1.25 mm, which yields 24 channels each with a $\Delta\theta$of about 1 milliradian (mrad). Such an FASC covers an extent of about 2500 millimeters (mm) in a Y dimension. However, if such an FASC is built using known techniques, the FASC would require plates having a 2.5 meter (m) width (Y) and a 0.75 m length (X), which are separated from each other by about 1.25 mm. The spacing and planarity of such plates must be held constant to a tolerance of 0.1 mm, however there are no known methods of producing such a large, low divergence collimator.

At least some other collimators having a Y dimension and a pitch as described above have a much smaller length than is desired for an FASC. For example, at least some computed tomography (CT) machines have anti-scatter grids with a length (in a Z-direction) of about 10 centimeters (cm), a pitch of about 1.25 mm, and a septa thickness of about 0.5 mm; however a height in an X-direction of travel of the X-rays for such a grid is only about 20 mm. As used herein, the term "septa" refers to walls or partitions that separate spaces, slits, cavities, slots, chambers, and/or other openings. Further, because of the lower height of the CT grid as compared to the about 0.75 m height of the FASC, fabrication techniques for forming the CT grid, such as maintaining slit spacing by holding plates at their edges using thin wires, cannot be applied to forming an FASC. Moreover, because of the size difference, the CT grid and the FASC each have different structure, design, and/or material choice considerations.

As such, it is desirable to provide a method for manufacturing an FASC that is mechanically precise and large enough to be used with an XDI system. Further, it is desirable to manufacture an FASC from a certain number of identical building blocks.

BRIEF SUMMARY OF THE INVENTION

In one aspect, a method for making a secondary collimator that includes at least one plate having a plurality of slits defined therein. The method includes determining a gap thickness between plate positions of the secondary collimator based on at least one dimension of the at least one plate and fabricating a base plate from a base plate blank. The base plate includes at least two slots being spaced apart by the gap thickness. The at least one plate is inserted into a first slot of the at least two slots to form the secondary collimator.

In another aspect, a secondary collimator is provided. The secondary collimator includes a plurality of substantially similar plates, wherein each plate of the plurality of plates includes a plurality of septa defining a plurality of slits, and a base plate defining a plurality of slots each configured to receive one plate of the plurality of plates. The plurality of slots are spaced apart by at least one gap thickness determined based on at least one dimension of the plurality of plates. The base plate is coupled to the plurality of plates.

In yet another aspect, an X-ray diffraction imaging (XDI) system is provided. The XDI system includes an X-ray source configured to generate an X-ray beam, a detector array configured to receive scattered radiation generated when the X-ray beam interacts with an object, and a secondary collimator positioned between the object and the detector array. The secondary collimator is configured to prevent scattered radiation at other than an angle $\theta$ from being received at the detector array and includes a plurality of plates that are substantially similar to each other. Each plate of the plurality of plates includes a plurality of septa defining a plurality of slits. The secondary collimator further includes a base plate defining a plurality of slots each configured to receive one plate of the plurality of plates. The plurality of slots are spaced apart by at least one gap thickness determined based on at least one dimension of the plurality of plates. The base plate is coupled to the plurality of plates.

By including a plurality of plates that are substantially similar to each other, the embodiments described herein provide a secondary collimator that can be manufactured using mass production techniques. Further, the determination of the gap thickness described herein facilitates manufacturing a relatively large collimator that is configured to facilitate permitting only radiation scattered at a unique angle in the object to reach the detector.

BRIEF DESCRIPTION OF THE DRAWINGS

FIG. 1 is a schematic cross-sectional view of an exemplary X-ray diffraction imaging (XDI) system.

FIG. 2 is a schematic cross-sectional side view of a secondary collimator that may be used with the XDI system show in FIG. 1.

FIG. 3 is a schematic top view of a plate that may be used with the secondary collimator shown in FIG. 2.

FIG. 4 is a schematic front view of the secondary collimator shown in FIG. 2 with a base plate not shown.

FIG. 5 is a flowchart of a method for making the secondary collimator shown in FIGS. 2-4.

FIG. 6 is a graph showing a relationship between a total thickness of the secondary collimator shown in FIG. 2 and a number of plates included in the secondary collimator.

DETAILED DESCRIPTION OF THE INVENTION

The embodiments described herein provide a secondary collimator based on Soller slits and a construction technique for forming Soller slit collimators of high aspect ratio. The secondary collimator described herein includes a number of simple, identical modules, or plates, each of which can be fabricated using mass production technology. For example, individual modules may be mass-produced using technologies such as sawing, casting and/or eroding to produce a precise but relatively inexpensive product, as compared to known collimators based on Soller slits. Further, an expression is described herein for determining spacings of successive modules to prevent or limit cross-talk rays traversing the collimator. More specifically, gaps between the modules increase in proportion to a number of modules included in the collimator. The embodiments described herein exhibit substantially identical performance to Soller's original design, but are much easier to build and have a lighter weight than Soller's original design.

Figure 1:
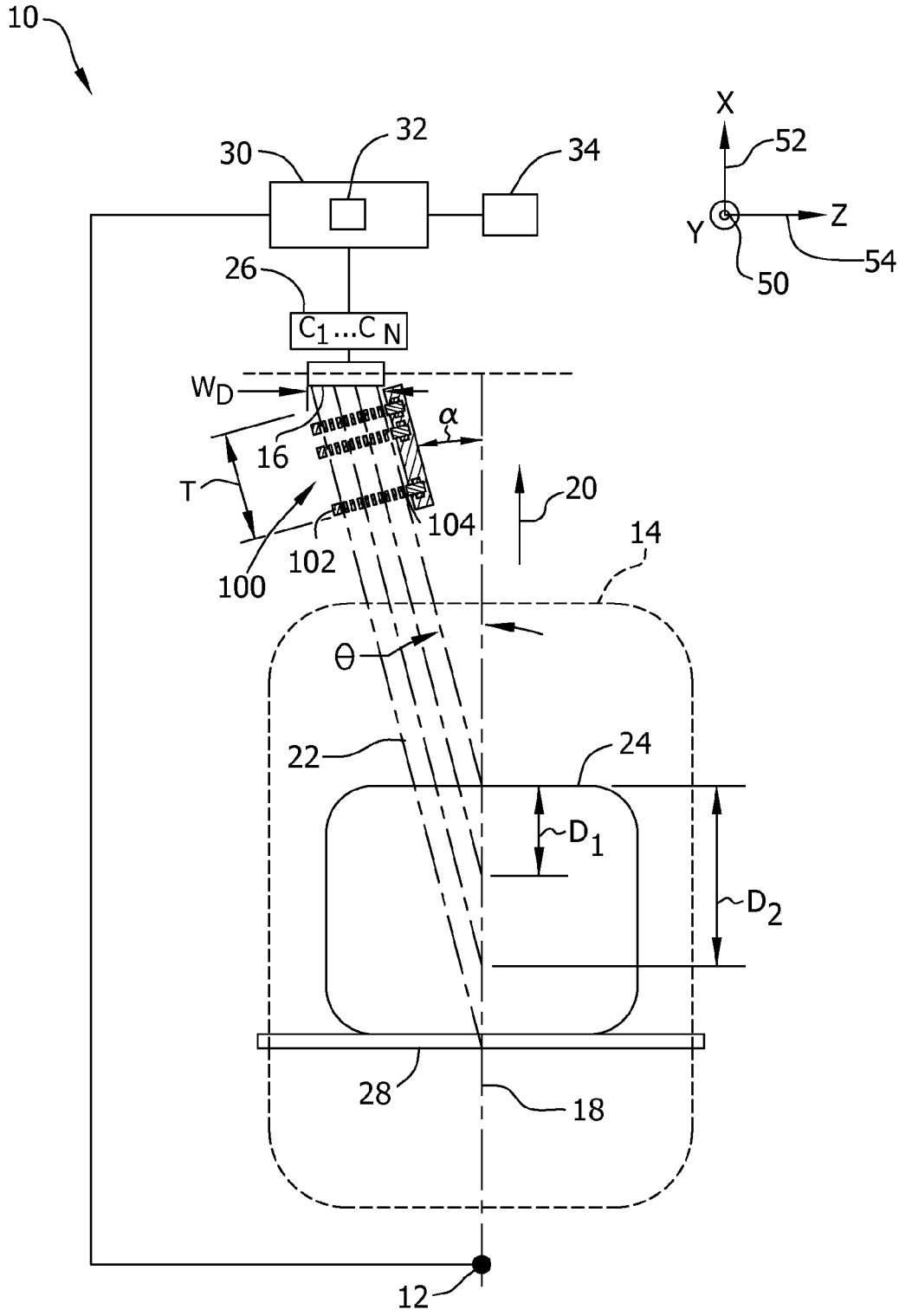
FIGS. 1-6 show exemplary embodiments of the systems and method described herein.

FIG. 1 is a schematic cross-sectional view, in an X-Z plane, of an exemplary embodiment of an X-ray diffraction imaging (XDI) system 10. In the exemplary embodiment, XDI system 10 includes an X-ray source 12, an examination area 14, a detector array 16, and a secondary collimator 100. X-ray source 12, in the exemplary embodiment, is a multi-focus X-ray source (MFXS) with discrete foci located on a Y-axis 50 that can be sequentially activated to emit an X-ray beam 18 along an X-axis 52 such that a direction 20 of X-ray beam 18 is substantially parallel to X-axis 52. As such, X-ray source 12 scans in a direction substantially perpendicular to direction 20 of X-ray beam 18. Further, X-ray source 12 with its primary collimator (not shown) is configured to generate a multiple inverse fan beam (MIFB).

In the exemplary embodiment, detector array 16 is a one-dimensional or two-dimensional pixellated detector array. Alternatively, detector array 16 includes a plurality of strips. In the exemplary embodiment, detector array 16 extends either along a Z-axis 54 or along Z-axis 54 and Y-axis 50 such that X-ray beam 18 is substantially perpendicular to detector array 16. Further, in the exemplary embodiment, detector array 16 has a width $W_D$ of approximately 30 mm such that each pixel (not shown) is approximately 1 $mm^2$ and includes more than fourteen detector elements (not shown), such as, but not limited to, 30 detector elements. Alternatively, detector array 16 has any width and/or number of detector elements that enables XDI system 10 to function as described herein. In the exemplary embodiment, detector array 16 is configured to detect and energy resolve polychromatic X-ray scattered radiation 22 (hereinafter referred to as "scattered radiation 22") passing through an object 24. Further, in the exemplary embodiment, detector array 16 includes a number of channels 26, for example, n number of channels $C_1, \ldots C_n$, wherein n is selected based on the configuration of XDI system 10.

In the exemplary embodiment, examination area 14 is at least partially defined by a support 28 configured to support object 24 within examination area 14. More specifically, in the exemplary embodiment, object 24 is baggage, luggage, cargo, and/or any other container in which contraband, such as explosives and/or narcotics, may be concealed. Support 28 may be a conveyor device, a table, and/or any other suitable support for object 24. Although in the exemplary embodiment, support 28 is positioned between object 24 and X-ray source 12, support 28 may be positioned between object 24 and detector array 16.

Secondary collimator 100, in the exemplary embodiment, is positioned between detector array 16 and object 24 and has a length (not shown) along Y-axis 50 of, for example, about 2.5 meters (m), and a width along Z-axis 54 of, for example, 4 centimeters (cm). In the exemplary embodiment, secondary collimator 100 includes at least one plate 102 defining a plurality of slits 104 that is configured to collimate scattered radiation 22 at an angle θ to X-ray beam 18. Secondary collimator 100, as described herein, is a fixed angle secondary collimator (FASC). More specifically, secondary collimator 100 includes a plurality of plates 102 stacked at predetermined spacings $g_1 \ldots g_N$ (shown in FIGS. 2 and 4), where N is one less than a number of plates 102 included in secondary collimator 100. Such spacings are described in more detail below. Although three plates 102 are shown in FIG. 1, it should be understood that secondary collimator 100 includes any suitable number of plates 102 that enables XDI system 10 to function as described herein.

Secondary collimator 100 is configured to facilitate ensuring that scattered radiation 22 arriving at detector array 16 has a constant scatter angle θ with respect to X-ray beam 18 and that a position of detector array 16 permits determination of a depth, such as $D_1$ and/or $D_2$, in object 24 at which the polychromatic X-ray scattered radiation 22 originated. As such, because XDI system 10 includes the MIFB topology for X-ray diffraction imaging, secondary collimator 100 is configured to restrict scattered radiation 22 arriving at detector array 16 to scattered radiation 22 that is scattered out of the scan plane at constant dihedral angle θ. For example, slits 104 of plates 102 are arranged parallel to a direction of scattered radiation 22 to absorb scattered radiation (not shown) that is not parallel to the direction of scattered radiation 22. More specifically, slits 104 are each oriented at an angle α to X-ray beam 18, which is substantially equal to angle θ of scattered radiation 22. In the exemplary embodiment, neither angle θ nor angle α is parallel to direction 20 of X-ray beam 18. Further, although FIG. 1 shows secondary collimator 100 positioned on one side of X-ray beam 18 with respect to Z-axis 54, secondary collimator 100 may be positioned on both sides of X-ray beam 18 with respect to Z-axis 54.

In the exemplary embodiment, XDI system 10 further includes a control system 30 operationally coupled to, such as in operational control communication with, X-ray source 12 and detector array 16. As used herein, "operational control communication" refers to a link, such as a conductor, a wire, and/or a data link, between two or more components of XDI system 10 that enables signals, electric currents, and/or commands to be communicated between the two or more components. The link is configured to enable one component to control an operation of another component of XDI system 10 using the communicated signals, electric currents, and/or commands.

Further, control system 30 is shown as being one device, however control system 30 may be a distributed system throughout XDI system 10, an area surrounding XDI system 10, and/or at a remote control center. Control system 30 includes a processor 32 configured to perform the methods and/or steps described herein. Further, many of the other components described herein include a processor. As used herein, the term "processor" is not limited to integrated circuits referred to in the art as a computer, but broadly refers to a controller, a microcontroller, a microcomputer, a programmable logic controller (PLC), an application specific integrated circuit, and other programmable circuits, and these terms are used interchangeably herein. It should be understood that a processor and/or control system can also include memory, input channels, and/or output channels.

In the embodiments described herein, memory may include, without limitation, a computer-readable medium, such as a random access memory (RAM), and a computer-readable non-volatile medium, such as flash memory. Alternatively, a floppy disk, a compact disc-read only memory (CD-ROM), a magneto-optical disk (MOD), and/or a digital versatile disc (DVD) may also be used. Also, in the embodiments described herein, input channels may include, without limitation, sensors and/or computer peripherals associated with an operator interface, such as a mouse and a keyboard. Further, in the exemplary embodiment, output channels may include, without limitation, a control device, an operator interface monitor and/or a display. In the exemplary embodiment, control system 30 is operationally coupled to a display device 34 for displaying an image generated using the methods and systems described herein.

Processors described herein process information transmitted from a plurality of electrical and electronic devices that may include, without limitation, sensors, actuators, compressors, control systems, and/or monitoring devices. Such processors may be physically located in, for example, a control system, a sensor, a monitoring device, a desktop computer, a laptop computer, and/or a distributed control system. RAM and storage devices store and transfer information and instructions to be executed by the processor(s). RAM and storage devices can also be used to store and provide temporary variables, static (i.e., non-changing) information and instructions, or other intermediate information to the processors during execution of instructions by the processor(s). Instructions that are executed may include, without limitation, imaging system control commands. The execution of sequences of instructions is not limited to any specific combination of hardware circuitry and software instructions.

During operation, XDI system 10 implements an inverse fan geometry to measure scattered radiation 22 from object 24 at a substantially constant in-plane angle θ. More specifically, X-ray source 12 emits X-ray beam 18 substantially parallel to X-axis 52. X-ray beam 18 passes through object 24 within examination area 14. As X-ray beam 18 passes through object 24, radiation is scattered at a range of angles to X-ray beam 18. At least some of the radiation is scattered radiation 22 at angle θ to X-ray beam 18. Scattered radiation 22 passes through slits 104 of secondary collimator 100 and is detected by detector array 16. Photon energy spectra collected by detector array 16 are transmitted through channels 26 to control system 30 for further processing. In one embodiment, such processing converts energy spectra to energy-dispersive X-ray diffraction (XRD) profiles and identifies a material (not shown) of object 24 using d-spacings between lattice planes of micro-crystals in the material, as described above.

Figure 2:
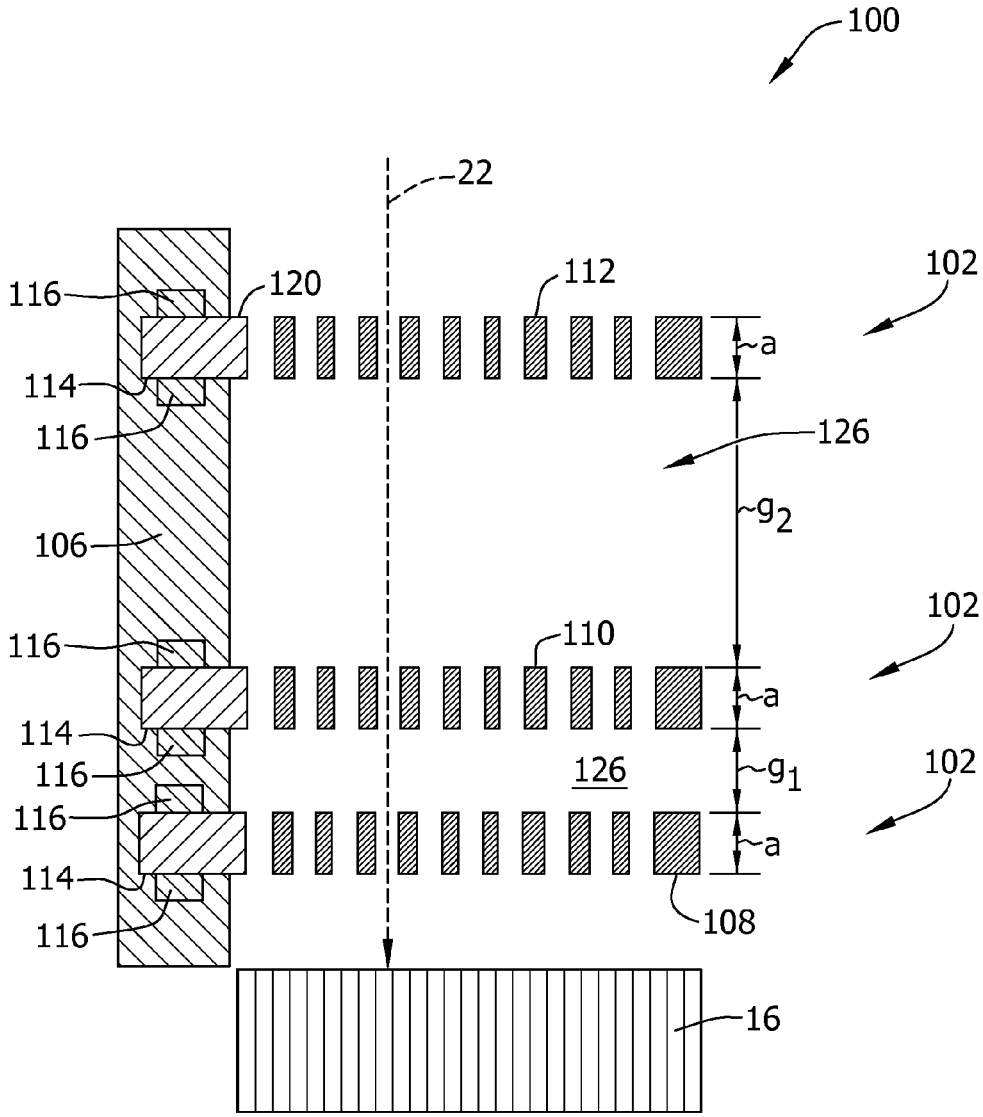
Figure 3:
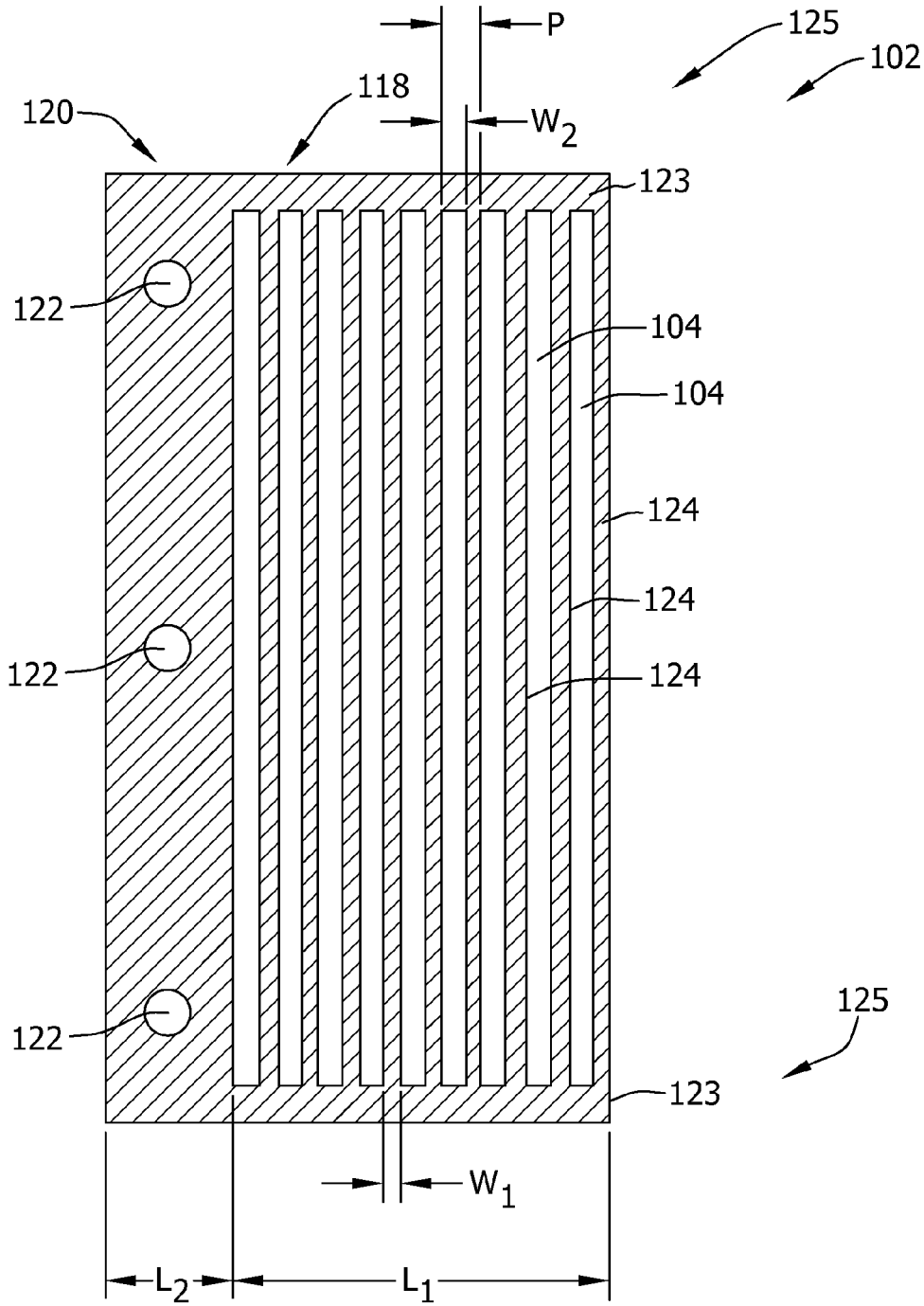
Figure 4:
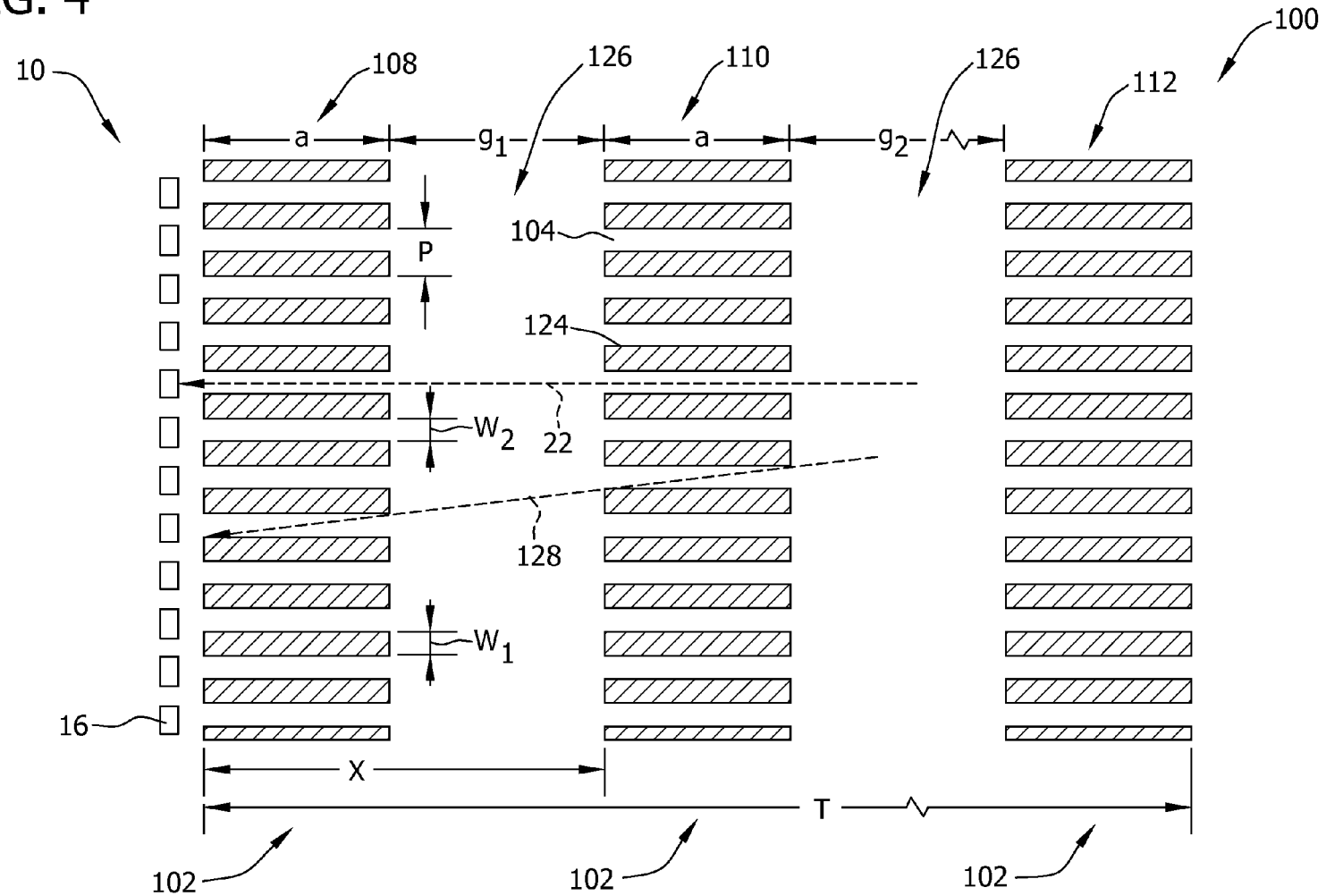

FIG. 2 is a schematic cross-sectional view of an exemplary secondary collimator 100 that may be used with XDI system 10 (shown in FIG. 1). FIG. 3 is a schematic top view of plate 102 that may be used with secondary collimator 100. FIG. 4 is a schematic front view of secondary collimator 100 with a base plate 106 removed for clarity.

In the exemplary embodiment, secondary collimator 100 includes a plurality of plates 102, such as a first plate 108, a second plate 110, and a third plate 112 shown in FIG. 2, for example. It should be understood that secondary collimator 100 may include any suitable number of plates 102 that enables secondary collimator 100 to function as described herein. In a particular embodiment, secondary collimator 100 includes from three plates 102 to ten plates 102. In the exemplary embodiment, each plate 108, 110, and 112, as shown in FIG. 2, is substantially similar such that each plate 108, 110, and 112 is interchangeable with any other plate 108, 110, and/or 112. As such, plate 102 is a generic plate and is referred to herein to indicate any plate of secondary collimator 100.

Plates 108, 110, and 112 are each coupled to a base plate 106 using, for example, mechanical fasteners. It should be understood that any suitable technique and/or fastener(s) can be used to couple plates 108, 110, and/or 112 to base plate 106, although mechanical fasteners enable maintenance and/or replacement to be performed on plates 108, 110, and/or 112. In the exemplary embodiment, plates 108, 110, and 112 are coupled to base plate 106 at a predetermined spacing, or gap thickness $g_N$, with respect to each other, as described in more detail below. Each plate 108, 110, and 112 is substantially perpendicular to base plate 106 and, thus, is substantially parallel to the other plates. Further, a gap 126, as shown in FIG. 4, is defined between each plate 102 coupled to base plate 106.

Base plate 106 is fabricated from a material that provides sufficient strength, rigidity, and/or other material characteristics that enable secondary collimator 100 to function as described herein and to facilitate maintaining precise spacing between plates 108, 110, and 112. Further, base plate 106 is configured to couple secondary collimator 100 within XDI system 10. In the exemplary embodiment, base plate 106 includes a plurality of slots 114 configured to receive a corresponding plate 102 and one or more apertures 116 configured to receive a mechanical fastener the secure plate 102 to base plate 106. Although only one base plate 106 is described herein, it should be understood that any suitable number of base plates 106 may be included in secondary collimator 100.

Referring to FIG. 3, plate 102 is shown and described, although it should be understood that such a description also applies to first plate 108, second plate 110, and third plate 112. Plate 102 is, in the exemplary embodiment, fabricated from a sheet of lead bronze having a first dimension or length in a Y-direction of about 2.5 m, a second dimension or height in a Z-direction of about 4 cm, and a third dimension or width in an X-direction of about 2 cm. Tungsten is not currently formed in sheets that are more than 1 m in length; however, tungsten and/or any other suitable radiation absorbing material can be used to form plate 102, depending on desired dimensions of secondary collimator 100. As used herein, the term "radiation absorbing material" includes materials that absorb and/or attenuate a relatively large amount of radiation that is directed to the material. Further, plate 102 can have any suitable dimensions based on a type and/or dimensions of XDI system 10 (shown in FIG. 1).

In the exemplary embodiment, plate 102 includes a collimating portion 118 and a support portion 120 that are formed integrally as one-piece with each other. Support portion 120 is formed from a continuous material with at least one aperture 122 defined therethrough. Aperture 122 corresponds to apertures 116 and is configured to receive a mechanical fastener, such as a screw or a bolt, to couple plate 102 to base plate 106. Alternatively, support portion 120 includes any suitable features for coupling plate 102 to base plate 106. In the exemplary embodiment, collimating portion 118 includes a plurality of septa 124 defining slits 104 therebetween. Transverse supports 123 extend between septa 124 and across slits 104 and ends 125 of plate 102 to provide support to plate 102. Although two transverse supports 123 are shown at ends 125 of plate 102, it should be understood that plate 102 may include any suitable number of supports 123 that are located at any suitable position of plate 102, including a central portion of plate 102.

Referring to FIGS. 2 and 3, each septa 124 has a width $W_1$ in the Z-direction, a regular pitch P in the Z-direction, a length $L_1$ in the Y-direction, and a thickness $\alpha$in the X-direction. As such, each slit 104 has a width $W_2$, and support portion 120 has length $L_2$. In one embodiment, length $L_1$ is about 3 cm, and $L_2$ is about 5 cm. Further, thickness a is about 12 mm, width $W_2$ is about 0.75 mm, and pitch P is about 1.25 mm. As such, width $W_1$ is about 0.5 mm. Alternatively, dimensions of support portion 120, septa 124, and/or slits 104 have any suitable values that enable secondary collimator 100 to function as described herein. In the exemplary embodiment, when plates 108, 110, and 112 are coupled to base plate 106, each septa 124 of first plate 108 substantially aligns with a respective septa 124 of second plate 110 and/or third plate 112.

Referring to FIG. 4, each plate 102 has thickness $\alpha$, gap 126 defined between first plate 108 and second plate 110 has a thickness $g_1$, and gap 126 between second plate 110 and third plate 112 has a second gap thickness $g_2$. When more than three plates 102 are included in secondary collimator 100, gaps 126 have thicknesses $g_1 \ldots g_N$, where N is one less than the number of plates 102. In the exemplary embodiment, each thickness, such as thickness $g_1$, is determined to facilitate preventing cross-talk radiation 128 from reaching or being received at detector array 16, as described in greater detail herein. As used herein, cross-talk radiation 128 is a ray of radiation that is directed through one slit 104 in first plate 108 and is directed through a neighboring slit 104 in second plate 110. Cross-talk radiation 128 may cause error in an image generated using scattered radiation 22. As such, secondary collimator 100 includes at least two plates 102 at a spacing to facilitate preventing cross-talk radiation 128 from reaching detector array 16 and/or traversing secondary collimator 100.

More specifically, to facilitate preventing cross-talk radiation 128 from reaching detector array 16 and/or traversing secondary collimator 100, gap thickness $g_1$ is determined based on dimensions of plate 102. More specifically, gap thickness $g_1$ is related to plate dimensions as follows:

$$g_1 \leq F \cdot \left(\frac{a \cdot W_1}{P - W_1}\right), \qquad \text{(Equation 1)}$$

where F is a tolerance factor. In the exemplary embodiment, factor F has a value less than unity (e.g. 1.0), for example, a value of 0.8, and is selected to provide a safety factor that accounts for machining, mounting, and/or other tolerances. For convenience below, a ratio $g_1/\alpha$is referred to herein as ratio $\gamma$.

Because substantially no cross-talk radiation 128 traverses secondary collimator 100 that includes at least two plates 102, secondary collimator 100 corresponds to a collimator having unbroken thickness $\tau$of $\alpha+g_1+\alpha$and a septa width of $W_1$. Consequently, second gap thickness $g_2$ can be written as:

$$g_2 = 2 \cdot \alpha\gamma + \alpha\gamma^2 \qquad \text{(Equation 2)}$$

As such, second gap thickness $g_2$ is larger than first gap thickness $g_1$. Equation 2 can be extended to determine a thickness of an Nth gap $g_N$ as follows:

$$g_N = \alpha \cdot [(1+\gamma)^N - 1] \qquad \text{(Equation 3)}$$

Hence a position X of an N+1 plate along a direction of propagation of scattered radiation 22 is:

$$X_{N+1} = a \cdot \left(N + \sum_{m=1}^{N} [(1+\gamma)^m - 1]\right) \qquad \text{(Equation 4)}$$

Figure 5:
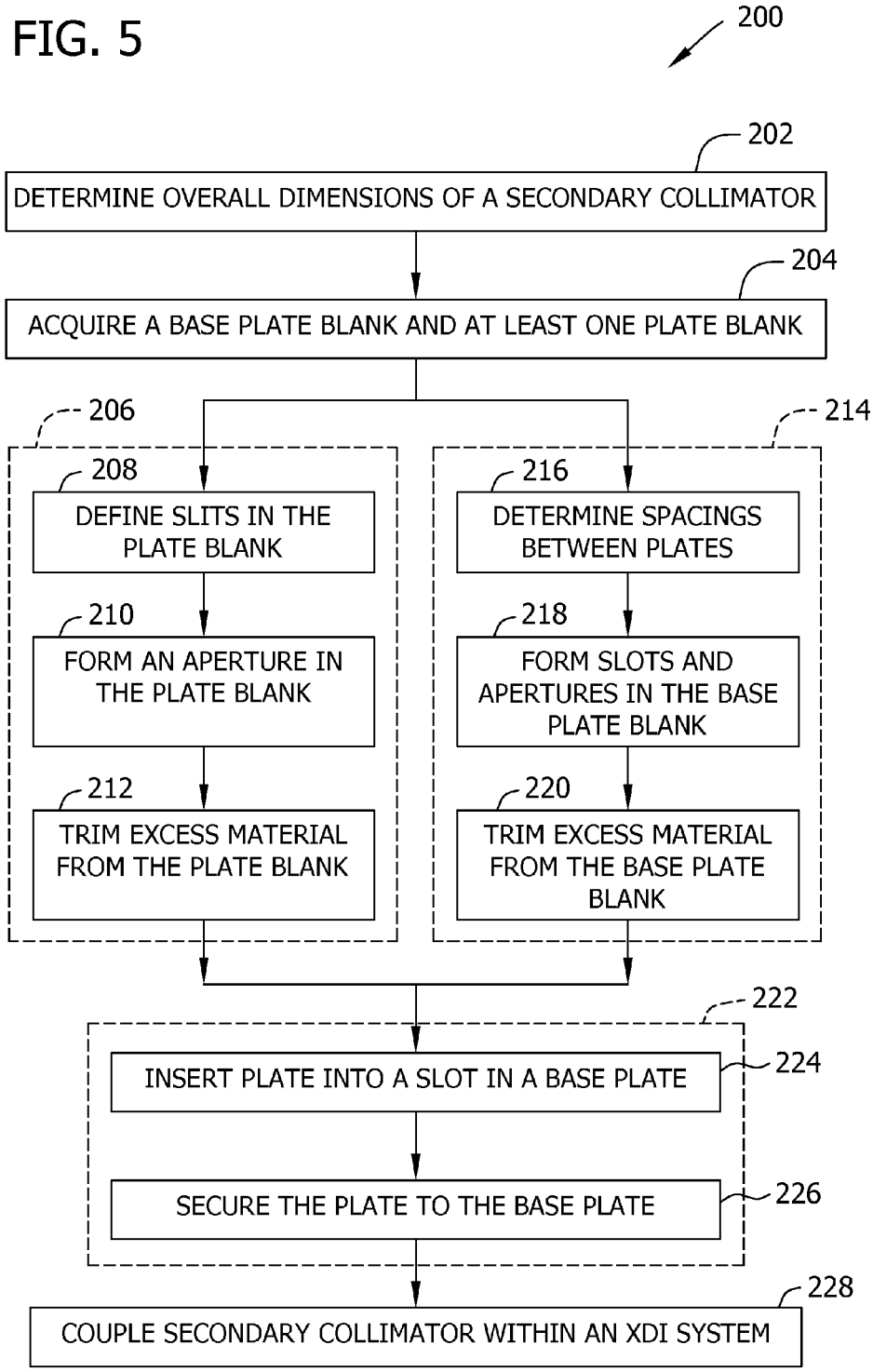

FIG. 5 is a flowchart of a method 200 of making secondary collimator 100 (shown in FIGS. 2-4). Referring to FIGS. 2-5, to fabricate and/or construct secondary collimator 100, overall dimensions for secondary collimator 100 are determined 202. For example, an overall thickness $\tau$of secondary collimator 100 is selected to determine the overall dimensions. Alternatively, a number of plates 102 (shown in FIGS. 1-4) is selected to determine 202 the overall dimensions. In the exemplary embodiment, a base plate blank and a number of plate blanks are manufactured, fabricated, bought, provided, and/or otherwise acquired 204. The base plate blank and the plate blanks are blocks of material suitable for forming base plate 106 and plate 102, respectively. In one embodiment, the base plate blank and the plate blanks are sized to be larger than a finished size of base plate 106 and plate 102, respectively.

At least one plate 102 is fabricated 206 from a plate blank using any suitable fabrication, construction, and/or manufacturing technique to form plate 102 as described herein. In the exemplary embodiment, slits 104 are defined 208 in the plate blank using, for example, a diamond saw. Slits 104 are defined 208 to have a substantially rectangular cross-sectional shape and to be substantially parallel to each other. By defining 208 slits 104, support portion 120 and collimating portion 118 are defined in the plate blank. In one embodiment, slits 104 are defined 208 to be about 0.75 mm wide with about 0.5 mm of material between each slit 104. The material remaining between slits 104 form septa 124. Each septa 124 also has a substantially rectangular cross-sectional shape and is substantially parallel to adjacent septa 124. Aperture 122 is formed 210 through the plate blank within support portion 120. The plate blank is then trimmed 212 to predetermined overall dimensions by removing excess material to fabricate plate 102 from the plate blank. Each plate 102 to be included in secondary collimator 100 is fabricated substantially similarly such that plates 102 are interchangeable building blocks of secondary collimator 100.

Base plate 106 is fabricated 214 from the base plate blank using any suitable fabrication, construction, and/or manufacturing technique to form base plate 106 as described herein. In the exemplary embodiment, spacings, or gap thickness $g_1 \ldots g_N$, between plates 102 are determined 216 using Equations 1-4. Apertures 116 corresponding to apertures 122 and slots 114 configured to receive each plate 102 are formed 218 in the base plate blank. More specifically, slots 114 are formed 218 at predetermined positions on the base plate blank according to the spacings determined 216 using Equations 1-4. As such, plates 102 are properly spaced with respect to each other to facilitate preventing or limiting cross-talk radiation 128 from reaching detector array 16. By using Equations 1-4, plates 102 are each located at a position X with respect to base plate 106. The base plate blank is then trimmed 220 to overall dimensions by removing excess material to fabricate base plate 106 from the base plate blank.

Plates 102 are then coupled 222 to base plate 106. In the exemplary embodiment, a predetermined number of plates 102 are coupled to base plate 106 to achieve the determined 202 overall dimensions of secondary collimator 100. Each plate 102 is inserted 224 in a slot 114 of base plate 106 such that support portion 120 of plate 102 is positioned within slot 114. Plate 102 is secured 226 within slot 114 using any suitable technique, fastener, and/or method. In the exemplary embodiment, a mechanical fastener is inserted through aperture 116 and aperture 122 to secure 226 plate 102 to base plate 106. After plates 102 are coupled to base plate 106 to form secondary collimator 100, secondary collimator 100 is coupled 228 within XDI system 10 between examination area 14 and detector array 16.

Figure 6:
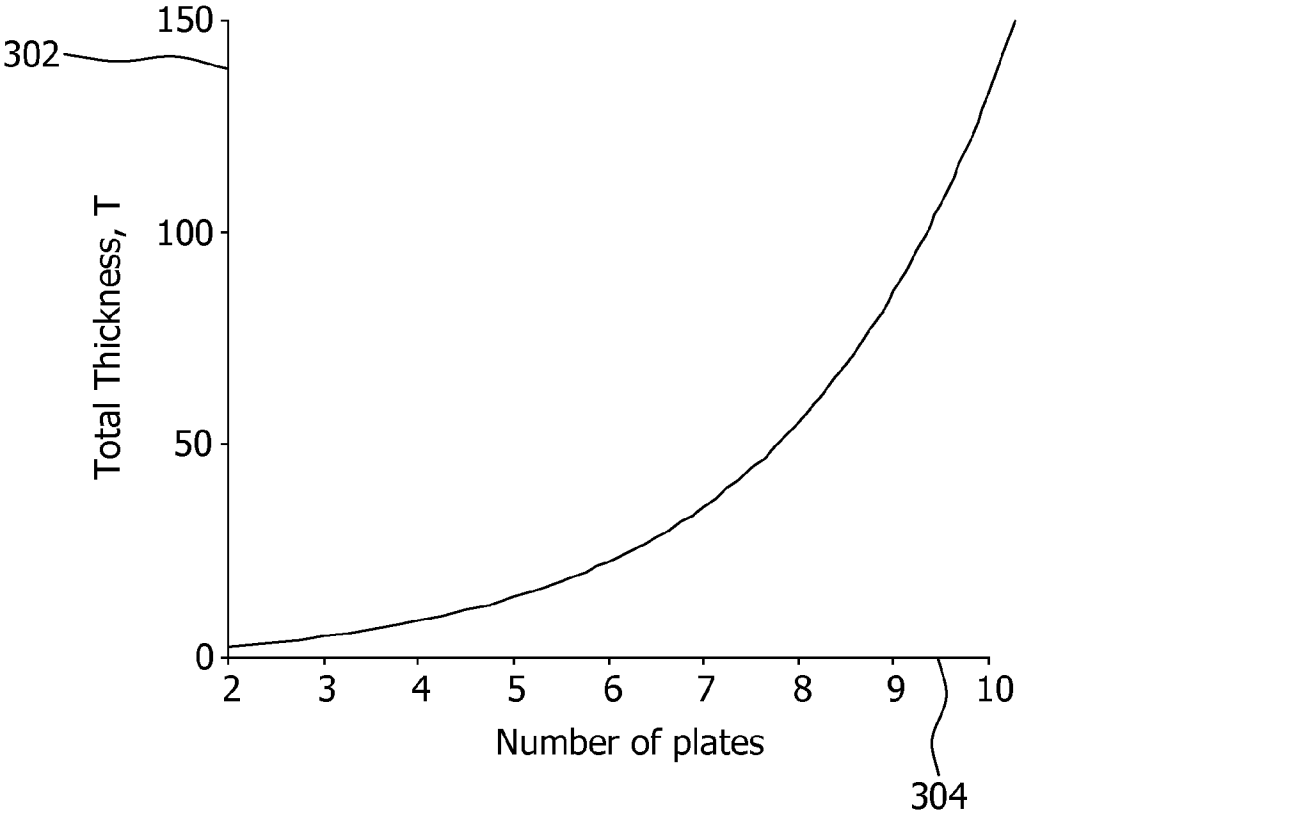

FIG. 6 is a graph 300 showing a relationship between a total thickness $\tau$ of secondary collimator 100 (shown in FIGS. 1-4) and a number of plates 102 (shown in FIGS. 1-4) included in secondary collimator 100. More specifically, the total thickness $\tau$ is plotted on a Y-axis 302 in units of the plate thickness $\alpha$, and the number of plates is plotted on an X-axis 304.

As shown in graph 300, the thickness $\tau$ of secondary collimator 100 increases relatively rapidly as the number of plates 102 is increased. For example, eight plates 102 form a secondary collimator that is approximately 55 times longer than the individual plate thickness $\alpha$. As such, using the above described methods, a secondary collimator of about 650 mm thick can be formed with eight plates 102, each having thickness a of about 12 mm, and having slits 104 (shown in FIGS. 1-4) of about 0.75 mm wide and a pitch of about 1.25 mm.

The above-described secondary collimator provides a collimator that is formed from a plurality of identical building blocks, such as a plurality of substantially similar plates. More specifically, the plates described herein are capable of being mass produced with accuracy sufficient for performing X-ray diffraction imaging. Further, the secondary collimator described herein has unique plate positions depending on the dimensions of the secondary collimator and/or components of the secondary collimator. Using the above-described equations and/or relationships, relatively large collimators can be formed using a relatively small number of plates. As such, the above-described collimator is simpler, more precise, and/or more cost-effective to manufacture or procure as compared to collimators manufactured using known techniques.

Exemplary embodiments of a secondary collimator and method for making the same are described above in detail. The systems and methods are not limited to the specific embodiments described herein, but rather, components of systems and/or steps of the methods may be utilized independently and separately from other components and/or steps described herein. For example, the methods may also be used in combination with other radiation imaging systems and methods, and are not limited to practice with only the X-ray diffraction imaging systems and methods as described herein. Rather, the exemplary embodiment can be implemented and utilized in connection with many other collimator applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A secondary collimator comprising:

a plurality of plates each comprising a plurality of elongated septa defining a plurality of elongated slits extending along a width of a respective plate of said plurality of plates; and a base plate defining a plurality of slots each configured to receive one plate of said plurality of plates, said plurality of slots spaced apart by at least one gap thickness determined based on at least one dimension of said plurality of plates, said base plate coupled to said plurality of plates such that the elongated slits of each plate of said plurality of plates are substantially parallel to the elongated slits of other plates of said plurality of plates, wherein the at least one gap thickness comprises a first gap thickness $g_1$ wherein:

$$g_1 \leq F \cdot \left(\frac{a \cdot W_1}{P - W_1}\right),$$

where F is a tolerance factor a is a thickness of each plate, $W_1$ is a width of each slit of said plurality of slits of each said plate, and P is a pitch of each plate.

2. A secondary collimator in accordance with claim 1, wherein the at least one gap thickness comprises an Nth gap thickness $g_N$ that is equal to:

$$g_N = a \cdot [(1+\gamma)^N - 1],$$

where $g_N$ is the Nth gap thickness, N is one less than a number of plates, and $\gamma$ is $g_1/a$.

3. A secondary collimator in accordance with claim 1, wherein each plate is substantially perpendicular to said base plate.

4. A secondary collimator in accordance with claim 1, wherein each said plate comprises:

a collimating portion comprising said plurality of septa defining said plurality of slits; and a support portion configured to couple said plate to said base plate, said collimating portion and said support portion formed integrally as one piece.

5. A secondary collimator in accordance with claim 1, wherein said plurality of plates are coupled to said base plate at positions that are configured to prevent scattered radiation at other than an angle $\theta$ from traversing said secondary collimator.

6. An X-ray diffraction imaging (XDI) system, comprising:

an X-ray source configured to generate an X-ray beam;

a detector array configured to receive scattered radiation generated when the X-ray beam interacts with an object; and a secondary collimator positioned between the object and said detector array, said secondary collimator configured to prevent scattered radiation at other than an angle $\theta$ from being received at said detector array, said secondary collimator comprising:

a plurality of plates each having a same configuration, each plate of said plurality of plates comprising a plurality of elongated septa defining a plurality of elongated slits extending along a width of a respective plate of said plurality of plates; and a base plate defining a plurality of slots each configured to receive one plate of said plurality of plates, said plurality of slots spaced apart by at least one gap thickness determined based on at least one dimension of said plurality of plates, said base plate coupled to said plurality of plates such that the elongated slits of each plate of said plurality of plates are substantially parallel to the elongated slits of other plates of said plurality of plates.

7. An XDI system in accordance with claim 6, wherein the at least one gap thickness is determined to facilitate reducing cross-talk radiation from being received at said detector array.

8. An XDI system in accordance with claim 6, wherein each septa of the plurality of septa has a first width, and each slit of the plurality of slits has a second width such that each plate of said plurality of plates has a pitch.

9. An XDI system in accordance with claim 6, wherein each plate of said plurality of plates has a same thickness.

10. An XDI system in accordance with claim 6, wherein a first plate of said plurality of plates is spaced from a second plate of said plurality of plates by a first gap thickness, and said second plate is spaced from a third plate of said plates by a second gap thickness, the second gap thickness different than the first gap thickness.

11. An XDI system in accordance with claim 6, wherein said plurality of septa of a first plate of said plurality of plates are substantially aligned with said plurality of septa of a second plate of said plurality of plates.

* * * * *